US011199321B1

(12) United States Patent
Aziz et al.

(10) Patent No.: US 11,199,321 B1
(45) Date of Patent: Dec. 14, 2021

(54) LIGHTING SYSTEM WITH ACOUSTIC SHROUD

(71) Applicant: Finelight, Inc, Union City, CA (US)

(72) Inventors: David Daoud Aziz, Pleasanton, CA (US); Jeffry Mellor, Union City, CA (US); Joseph Chung, San Ramon, CA (US); Enemisio Gabriel Cano, Modesto, CA (US); Marlon Ebido, Oakland, CA (US)

(73) Assignee: Finelite INC., Union City, CA (US)

( * ) Notice: Subject to any disclaimer, the term of this patent is extended or adjusted under 35 U.S.C. 154(b) by 0 days.

(21) Appl. No.: 16/974,254

(22) Filed: Dec. 3, 2020

Related U.S. Application Data

(60) Provisional application No. 62/974,371, filed on Dec. 4, 2019.

(51) Int. Cl.

| | |
|---|---|
| ***F21V 33/00*** | (2006.01) |
| ***F21V 3/00*** | (2015.01) |
| ***F21S 8/00*** | (2006.01) |
| ***F21S 8/06*** | (2006.01) |
| ***G10K 11/162*** | (2006.01) |
| ***F21Y 105/10*** | (2016.01) |
| ***F21Y 115/10*** | (2016.01) |
| ***F21V 23/00*** | (2015.01) |
| ***F21V 23/06*** | (2006.01) |

(52) U.S. Cl.
CPC ..... *F21V 33/0056* (2013.01); *F21S 8/033* (2013.01); *F21S 8/06* (2013.01); *F21V 3/00* (2013.01); *G10K 11/162* (2013.01); *F21V 23/003* (2013.01); *F21V 23/06* (2013.01); *F21Y 2105/10* (2016.08); *F21Y 2115/10* (2016.08)

(58) Field of Classification Search
CPC ..... F21V 33/0056; F21V 3/00; F21S 8/033; F21S 8/06; G10K 11/162
USPC ..... 362/368
See application file for complete search history.

(56) References Cited

U.S. PATENT DOCUMENTS

| | | | | |
|---|---|---|---|---|
| 2,935,151 | A * | 5/1960 | Watters | G10K 11/16 52/145 |
| 5,782,551 | A * | 7/1998 | Capaul | B32B 15/14 362/148 |
| 7,971,680 | B2 * | 7/2011 | Morgan, III | E04B 9/0435 181/205 |
| 9,822,938 | B2 * | 11/2017 | De Gier | F21V 3/04 |
| 10,030,850 | B2 * | 7/2018 | Vissenberg | F21V 3/08 |
| 2018/0268797 | A1 * | 9/2018 | Lowry | G10K 11/002 |

* cited by examiner

*Primary Examiner* — Bryon T Gyllstrom
(74) *Attorney, Agent, or Firm* — James A. Gavney, Jr.; JAG Patent Services

(57) ABSTRACT

A LED lighting system includes a soundproofing attachment, referred to as an acoustic shroud. The lighting system includes LED light fixtures with the acoustic shroud made from sound dampening materials formed into a sleeve or panels, which can be slipped on an off an LED light fixture unit. The system can include quick-release fasteners for affixing and removing the shroud from an uninstalled or installed light fixture. Quick-release fasteners can enable the attachment of the shroud to accommodate multiple types of light fixtures and installation methods, such a wall or suspended ceiling lighting designs, as well as allow for the adjustment of the position of the shroud in relationship to the LED light fixture unit.

12 Claims, 8 Drawing Sheets

LIGHTING SYSTEM WITH ACOUSTIC SHROUD

RELATED APPLICATION

This application claims priority under 35 U.S.C. § 119(e) from the U.S. provisional patent application Ser. No. 62/974,371, filed on Dec. 4, 20219, and titled "LIGHTING SYSTEM WITH ACOUSTIC SHROUD." The provisional patent application Ser. No. 62/974,371, filed on Dec. 4, 20219, and titled "LIGHTING SYSTEM WITH ACOUSTIC SHROUD" is hereby incorporated by reference.

FIELD OF THE INVENTION

This invention relates to lighting systems. More specifically, this invention relates to Light Emitting Diode (LED) devices and systems equipped with an acoustic shroud.

BACKGROUND OF THE INVENTION

Soundproofing is any means of reducing sound through the use of noise barriers (that reflect or absorb the energy of the sound waves), damping structures (such as sound baffles), or by masking the sound (with active anti-noise sound generators). Damping reduces acoustic resonance in a room, mechanical resonance in the structure of the room itself, or things in the room by absorption or redirection. Absorption reduces the overall sound level, converting part of the sound energy to a very small amount of heat in the intervening object (the absorbing material), rather than sound being transmitted or reflected. The choice of sound absorbing material will be determined by the frequency distribution of noise to be absorbed and the acoustic absorption profile required.

In large, architecturally open interiors with many hard surfaces, the effect of resonance creates distracting amounts of ambient noise that may exceed OSHA worker standards or disrupt worker efficiency. Commercial businesses such as restaurants, schools, offices and health care facilities, use soundproofing technology within interior spaces to minimize noises which impede worker and customer comfort. While residential sound mitigation typically aims to decrease or eliminate the effects of exterior noise through the specification of windows and doors, interior soundproofing applications can supplement the use of architectural solutions.

Common products with soundproofing properties for interiors include acoustic paneling to absorb sound or block sound transmission from one place to another. However, modern open work areas often have few dividing walls as well as interiors with extensive glazing, limiting the use of extensive vertical acoustic paneling. Alternate dampening materials, such as carpeting, can be applied to horizontal surfaces, although architectural or sanitation concerns may make acoustic flooring impractical. Acoustic ceiling clouds made of metal, fabric, or foam can be suspended from ceilings, but may limit the amount of light available through shadowing, blocking the maximum illumination from artificial lights or natural daylight from skylights, reducing effective illumination of an interior.

There have been light fixtures with acoustic dampening features disclosed, such as the acoustical light fixture described by Capaul in U.S. Pat. No. 5,782,551. Capaul teaches an acoustic structure that frames the outside and/or covers a front portion a recessed fluorescent tube light fixture.

SUMMARY OF THE INVENTION

The present invention is directed to a lighting system with a light fixture or device with a acoustic shroud. The lighting device includes a first master circuit board with connectors configured to power light emitting diodes. The first master circuit board is coupled to a transformer for converting alternating current to direct current for powering the light emitting diodes. The lighting device further includes a first set of modular light boards with arrays of light emitting diodes. Preferably, the light emitting diodes used in the lighting device of the present invention each use 0.2 watts or less of electrical power. Also, preferably each of the modular light boards within the first set of modular light boards include an array of 20 or more light emitting diodes and upwards of 40 or more light emitting diodes.

The first set of modular light boards have matched connectors that detachably and interchangeably couple to the connectors on the first master circuit board. Accordingly, modular light boards are capable of being changed in the event that any one of the modular light boards fails or diodes on any one of the modular light boards fail. Also, modular light boards of the present invention can be added or removed according to the lighting needs of the environment where the lighting device is installed.

The lighting device also includes a housing for holding the first master circuit board and the first set of modular light boards. Preferably, the housing is an elongated housing with a first diffuser lens. The first master circuit board is positioned within the elongated housing, such that light emitted from the arrays of light emitting diodes on the first set of modular light boards is emitted through the first diffuser lens.

In further embodiment of the invention, the lighting device further comprising aa second master circuit board with connectors configured to power light emitting diodes. The second master circuit board is configured to power and electrically couple to a second set of modular light boards having arrays of light emitting diodes, such as decided above with reference to the first master circuit board. In accordance with this embodiment of the invention the lighting device also includes a second diffuser lens coupled to the elongated housing and positioned on an opposed side of the elongated housing relative to the first diffuser lense. In operation, the second master circuit board is configured to emit light from the arrays of light emitting diodes on the second set of modular light boards through the second diffuser lense.

In yet further embodiments of the invention, the lighting device includes a controller for independently controlling light output from the first set of modular light boards and the second set of modular light boards. Alternatively, or in addition to the control feature described above, the lighting device is configured with a controller for selectively controlling light output from any of the arrays of light emitting diodes on any one of the modular light boards of the first master circuit and the second master circuit.

The interchangeable and modular features of the modular light boards allows for the construction of unique lighting systems that are either suspended from a ceiling or wall and/or that are integrated into a ceiling or wall. In accordance with the embodiments of the invention, the lighting device includes one or more mounting features or hardware for securing the lighting device to a wall or a ceiling. For example, the lighting device includes one or more cable features for mounting to a ceiling, one or more bracket features for mounting to a wall and/or adjustable or fixed flange features for mounting the lighting device recessed within a wall.

The light fixture or device of the present invention preferably includes an acoustic shroud structure formed from acoustic panels that wrap around and/or attached to portions of sides walls or protruding walls of pendent-like light fixtures.

The acoustic panels of the acoustic shroud structure are patterned in any number of ways for dampening noise or reducing acoustic reflection. The acoustic panels are formed from any number of, or any combination of suitable materials including, but not limited to, plastic, foam, cellulose, vegetable-based materials and woven fabric or cloth.

The acoustic panels of the acoustic shroud structure are attached to each other or are separate. The acoustic shroud structure and/or acoustic panels attache to the portions of side walls or protruding walls of the pendent-like light fixtures by any suitable attachment means including, but not limited to, magnets, hook and loop fabric, adhesives pads, clips, hooks, screws. In accordance with the embodiments of the invention, the attachment means include quick release gravity clips or gravity wedges attached to inner walls of the acoustic shroud. Alternatively, the acoustic shroud structure can be form fitted such that the acoustic shroud structure compassion fits or stretches around side walls or protruding walls of the pendent-like light fixture.

Regardless of how the acoustic shroud structure or acoustic panels are attached to attached to portions of sides walls or protruding walls of pendent-like light fixtures the acoustic shroud structure of acoustic panels are in accordance with embodiments of the invention over sized, such that the portions of the acoustic shroud or acoustic panels extend past heights of the side walls of the pendent-like light fixtures to which they are affixed.

DETAILED DESCRIPTION OF THE INVENTION

Figure 1A:
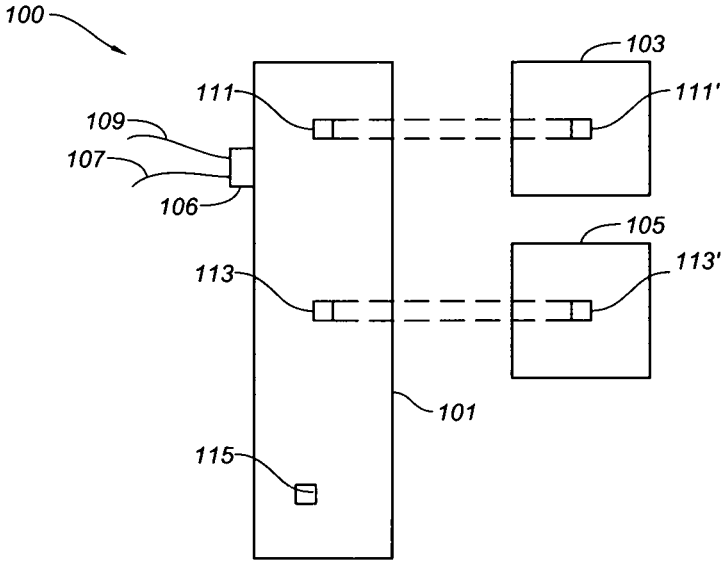
FIG. 1A is a schematic representation of a master circuit board with modular light boards having matched connectors that detachably and interchangeably couple to the connectors on the master circuit board, in accordance with the embodiments of the invention.

FIG. 1A is a schematic representation 100 of a master circuit board 101 with modular light boards 103 and 105 that have matched connectors 111' and 113' that detachably and interchangeably couple to the connectors 111, 113, 115 on the master circuit board 101. The master circuit board 101 includes, or is electrically coupled to, a transformer 106 for converting alternating current from power leads 107 and 109 into direct current for powering light emitting diodes. The master circuit board 101 along with modular light boards 103 and 105 are used in a lighting device such as described in detail below.

Figure 1B:
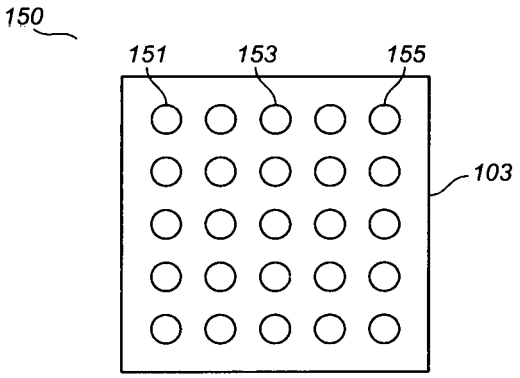
FIG. 1B shows of an array of light emitting diodes on a modular light board that electrically couples to the master circuit board, in accordance with the embodiments of the invention.

FIG. 1B shows a schematic representation 150 of an array of light emitting diodes 151, 153 and 155 on a modular light board 103 that electrically couples to a master circuit board 101 (FIG. 1A). Each of the modular light boards 103 and 105 in the lighting device of the present invention include arrays of light emitting diodes with 20 or more discrete light emitting diodes and upwards of 40 or more discrete light emitting diodes. Preferably, the discrete light emitting diodes used in the lighting device of the present invention each use 0.2 watts or less of electrical power.

The modular light boards 103 and 105 of the lighting device are capable of being individually changed in the event that any one of the modular light boards 103 and 105 fails or diodes on any one of the modular light boards 103 and 105 fails. A lighting device or lighting system of the present invention includes any number of modular light boards and modular light boards can be added or removed according to lighting needs of the environment where the lighting device is installed.

Figure 2A:
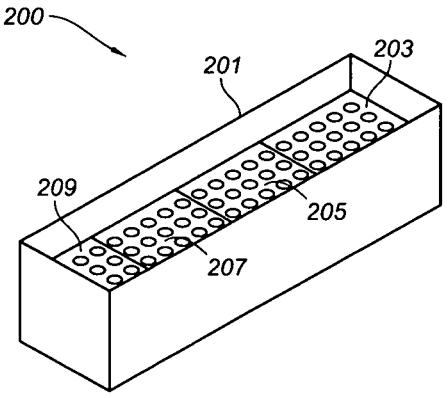
FIG. 2A shows a perspective view of a lighting device with an elongated housing, in accordance with the embodiments of the invention.

FIG. 2A shows a perspective view of a lighting device 200 with an elongated housing 201, in accordance with the embodiments of the invention. The elongated housing 201 is configured for holding one or more master circuit boards each with any number of modular light boards 203, 205, 207 and 209 with each of the modular light boards having arrays of light emitting diodes, such as described above. Preferably, the elongated housing 210 has a diffuser lens (not shown) that is positioned in front of the arrays of light emitting diode for diffusing light emitted therefrom.

Figure 2B:
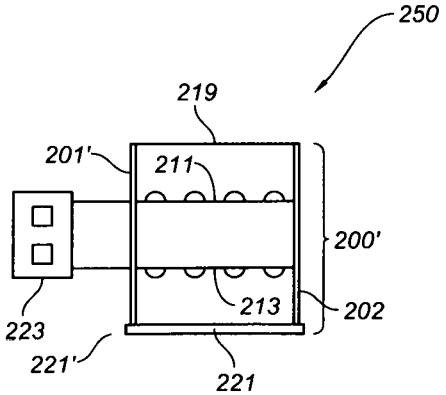
FIG. 2B shows a cross-sectional view of a lighting device with stacked arrays of light emitting diodes for emitting light through opposed sides of a housing structure, in accordance with the embodiments of the invention.

FIG. 2B shows a cross-sectional view 250 of a lighting device 200' with stacked arrays of light emitting diodes 211 and 213 for emitting light through opposed sides of a housing structure 201'. The stacked arrays of light emitting diodes 211 and 213 are positioned on any number of modular light boards that are eclectically coupled to a respective master circuit through matched connectors, such as described above with reference to FIG. 1A. Each of the master circuit board is electrically coupled to a transformer and any other necessary circuitry for powering the stacked arrays of light emitting diodes 211 and 213 from an alternating current power source (not shown).

Still referring to FIG. 2B, in accordance with the embodiments of the invention the lighting device 200' includes a controller 223. The controller 223 allows for independently controlling light output from each master circuit board, from each modular light boards and/or from each of the stacked arrays of light emitting diodes 211 and 213. Preferably, the lighting device 200' includes diffuser lenses 219, and 221 positioned in front of each of the stacked array of light emitting diodes 211 and 213, respectively. In accordance with further embodiments of the invention one of the diffuser lenses 221, or both of the diffuser lenses, extends along a wall portion 202 of the housing 201, such that soft-wash lighting emits from side surfaces 221' of the diffuser lens 221 with the array of light emitting diodes 213 powered on.

Figure 3A:
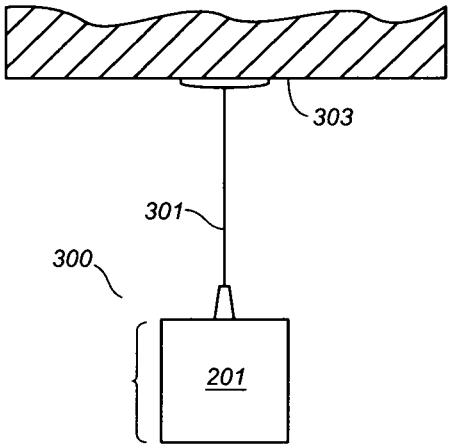
FIGS. 3A-B show mounting features for securing a lighting device to a wall or a ceiling, in accordance with the embodiments of the invention.
Figure 3B:
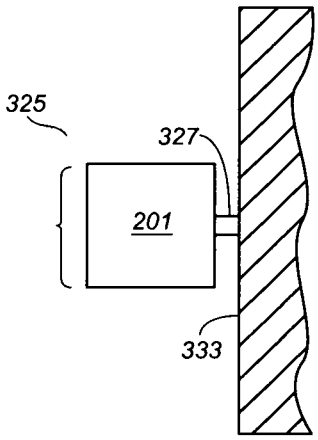

FIGS. 3A-B show several mounting features for securing a lighting device of the present invention to a wall or a ceiling, in accordance with the embodiments of the invention. FIG. 3A shows a view 300 of a lighting device 201 that is attached to a ceiling 303 through a cable feature 301. FIG. 3B shows a view 325 of a lighting device 201 attached to a wall 333 through a bracket feature 327.

Figure 3C:
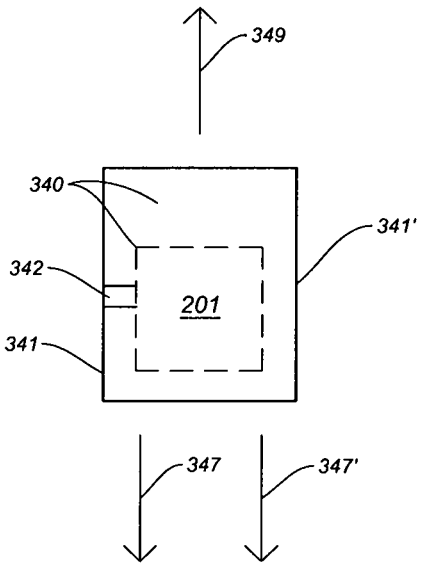
FIGS. 3C-D show lighting devices with an acoustic shrouds surrounding or attached to outside walls of the lighting devices shown in FIGS. 1A-B, in accordance with the embodiments of the invention.
Figure 3D:
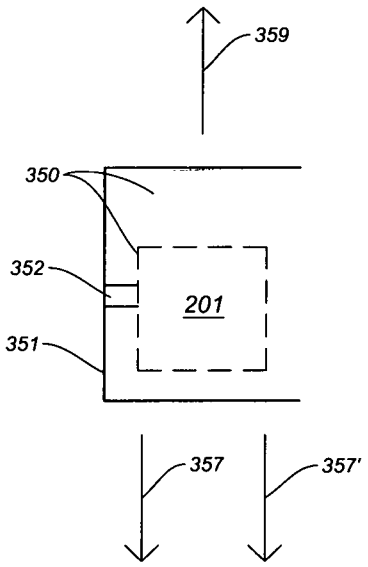

FIGS. 3C-D show the lighting devices 201 in FIGS. 1A-B with acoustic shrouds 341 and 351 surrounding or attached to walls 340 and 350 of the lighting devices 201. The acoustic shrouds 341 and 351 that are secured to outside walls 340 and 350 of the light fixtures 201 through magnets, hook and loop fabric, adhesives pads, clips, hooks or screws represented by 342 and 352. Alternatively, the acoustic shrouds 341 and 251 can also be form fitted such that the acoustic shrouds 341 and 351 compassion fit or stretch around outside walls of the light fixtures 201. The acoustic shrouds 341 and 351 preferably do not eclipse of cover light emitting surfaces of the lighting devices 201 such that the lighting system provides upward lighting, represented by arrows 349 and 359 and/or downward lighting, represented by arrows 347/347' and 357/357'.

It will be clear to one skilled in the art, that while the lighting devices 201 of the present invention are mostly described and being elongated pendent-type light fixtures, other shapes and geometries, such as square lighting devices, triangular lighting devices and round lighting devices are contemplated. Further, lighting devices of the present invention can include any number of different types mounting features or mounting hardware.

Figure 4:
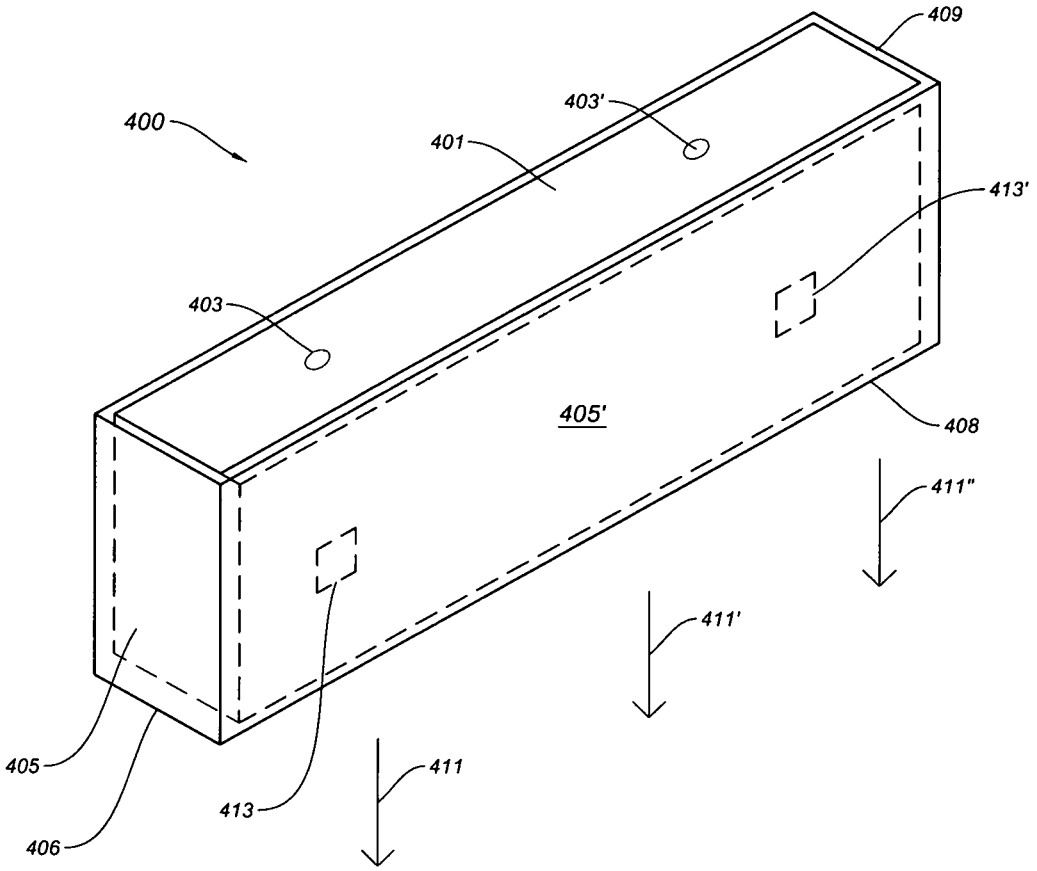
FIG. 4 illustrates a pendent-type light fixture with an acoustic shroud surrounding outside walls of the pendent-type light fixture, in accordance with the embodiments of the invention.

FIG. 4 illustrates a lighting system 400 that includes a pendent-type light fixture 401 with an acoustic shroud structure 409. The acoustic shroud structure 409 surround outside walls 405 and 405' of the pendent-type light fixture 401. The pendent-type light fixture 401 has mounting features 403 and 403' for attaching the pendent-type light fixture 401 to a ceiling or wall, such as described above with reference to FIGS. 3A-B.

The acoustic shroud structure 409 is formed form acoustic panels 406 and 408 that around and/or attached to portions of sides walls or protruding walls 405 and 405' of pendent-like light fixture 401. The acoustic panels 406 and 408 of the acoustic shroud structure 409 are patterned in any number of ways for dampening noise or reducing acoustic reflection, such as described with respect to FIGS. 9A-C. The acoustic panels 406 and 408 are formed from any number of or any combination of suitable materials, including but not limited to plastic, foam, cellulose, vegetable-based materials and woven fabric or cloth.

The acoustic panels 406 and 408 of the acoustic shroud structure 409 are attached to each other or are separate. The acoustic shroud structure 409 and/or acoustic panels 406 and 408 attached to the portions of the outside walls or protruding walls 405 and 405' of the pendent-like light fixture 401 by any suitable attachment means including, but not limited to, magnets, hook and loop fabric, adhesives pads, clips, hooks and screws 413 and 413'. The lighting system 400 can include quick-release fasteners 413 and 413' for affixing and removing the acoustic shroud structure 409 and/or acoustic panels 406 and 408 from an uninstalled or installed pendent-type light fixture 401. Quick-release fasteners can enable the attachment of the shroud to accommodate multiple types of light fixtures and installation methods, such a wall or suspended ceiling lighting designs, as well as allow for the adjustment of the position of the shroud in relationship to the LED light fixture unit.

The quick release fasteners for attaching the acoustic shroud structure 409 tro the pendent-like light fixture 401 are, for example, quick release gravity assisted wedge clips, such as the gravity assisted wedge clips 711/711' and 713/713' shown in FIGS. 7A-E. Regardless of how the acoustic shroud structure 409 and/or acoustic panels 406 and 408 attach to the pendent-like light fixture 401, the acoustic shroud structure 409 and/or acoustic panels 406 and 408 preferably do not cover light emitting surfaces, such that pendent-like light fixture 401 provides at least provide downward lighting, represented by the arrows 411, 411' and 411".

Figure 5A:
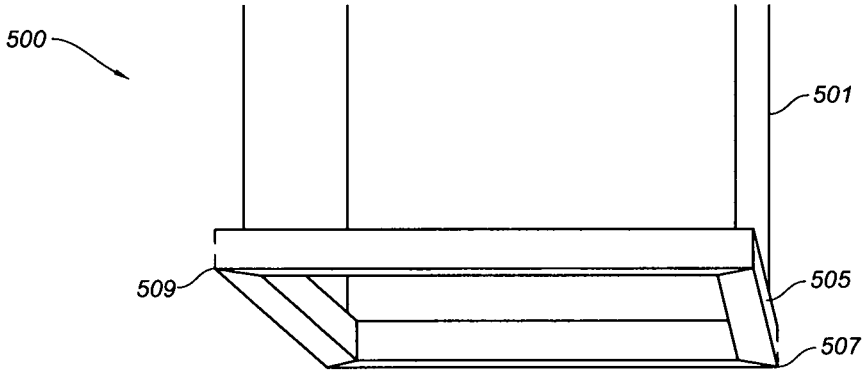
FIG. 5A shows a view of a rectangular lighting device that is suspended from a ceiling through a number of cable features, in accordance with the embodiments of the invention.
Figure 5B:
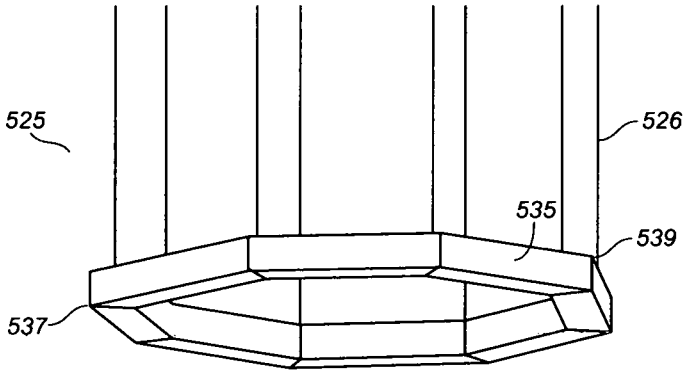
FIG. 5B shows a view of an octagonally shaped lighting device that is suspended from a ceiling through a number of cable features, in accordance with the embodiments of the invention.

The interchangeable and modular features of the lighting device of the present invention also allows for the construction of unique lighting devices that are either suspended from a ceiling or wall using the mounting features, such as described with reference to FIGS. 3A-B. For example, FIG. 5A shows a view 500 of a rectangular lighting device 505 that is suspended from a ceiling through a number of cable features 501. The corners 507 and 509 provide continuous and even or uniform lighting. FIG. 5B shows a view 525 of an octagonally shaped lighting device 535 that is suspended from a ceiling through an number of cable features 526. Again, the angled portions 537 and 539 of the lighting device provide continuous and even or uniform lighting.

Figure 6:
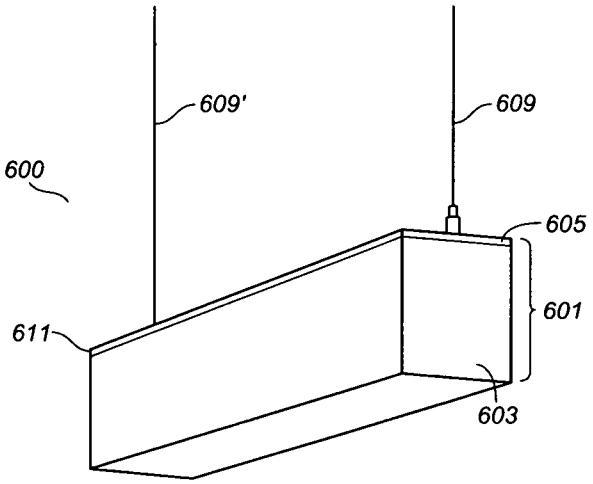
FIG. 6 shows a schematic representation of an elongated lighting device with soft-wash side lighting features, in accordance with the embodiments of the invention.
Figure 7A:
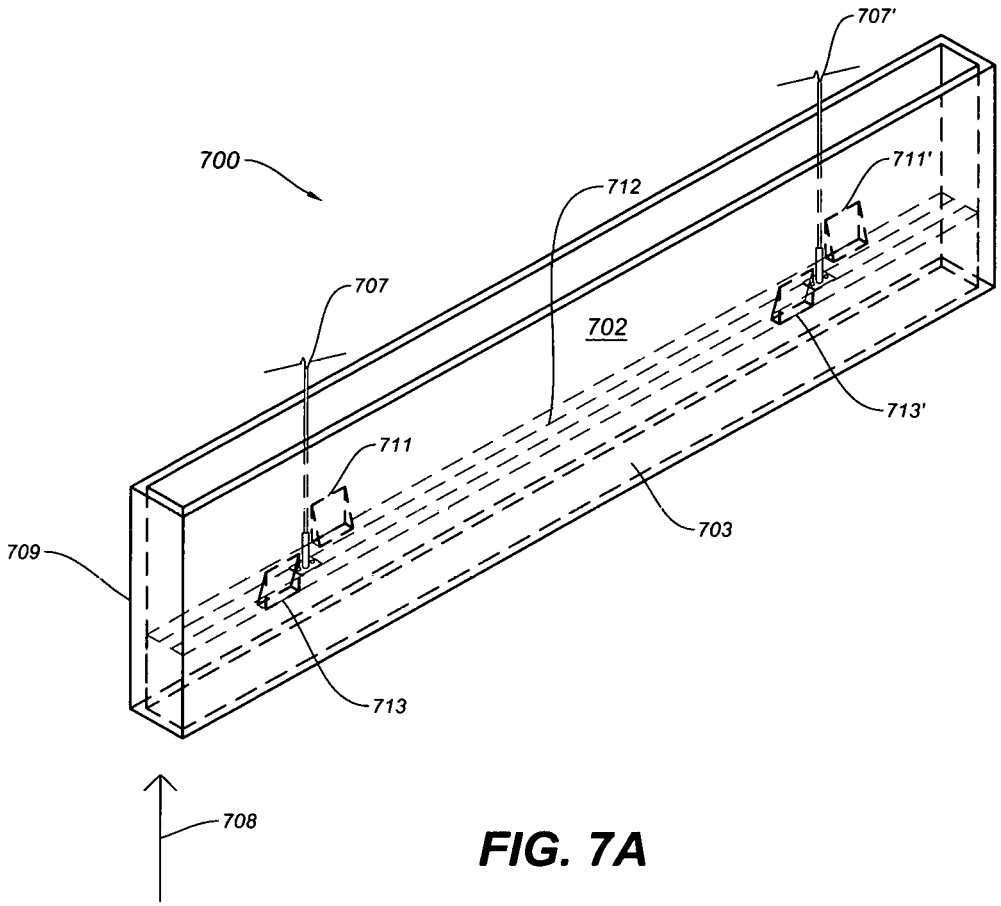
FIGS. 7A-E show a pendent-type light fixture with and over-sized acoustic shroud attached to the pendent-type light fixture through gravity clips or wedges, in accordance with the embodiments of the invention.
Figure 7B:
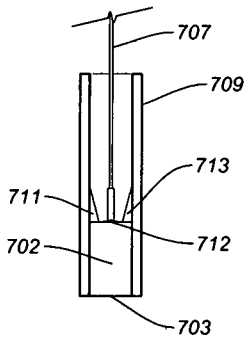
Figure 7C:
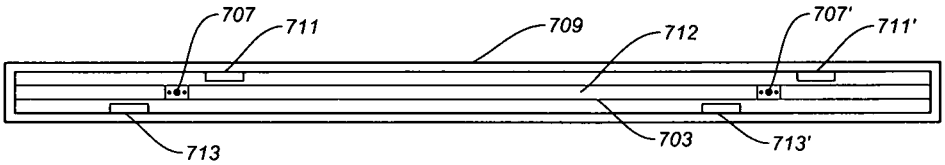
Figure 7D:
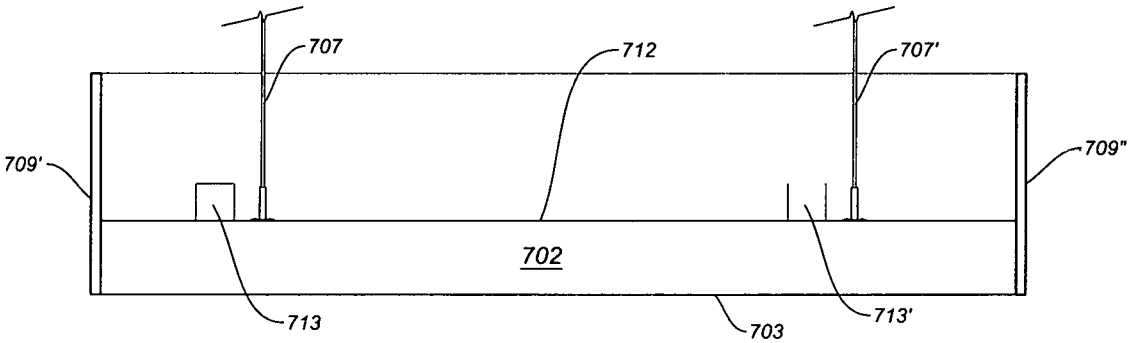
Figure 7E:
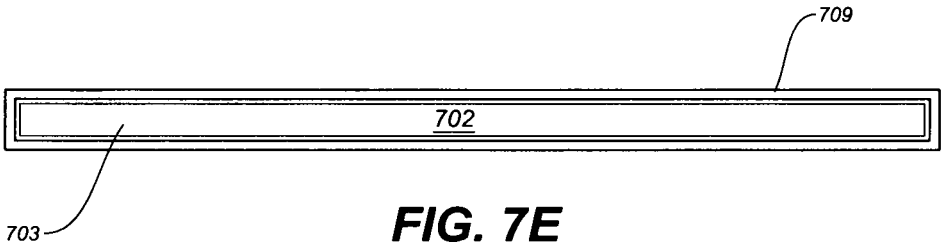

FIG. 6 shows a view 600 of a lighting device 601 with an elongated housing for housing stacked arrays of light emitting diodes 211 and 213 (FIG. 2B) that emit light through opposed sides of the elongated housing. In this example, the lighting device 601 is suspended from a ceiling through cable features 609 and 609'. However, as mentioned, any number of mounting features and/or mounting hardware are contemplated to be used for installing the lighting device 601.

Preferably, the lighting device 600 includes a controller, such as described with reference to FIG. 2B, for independently controlling light output from each of the stacked arrays of light emitting diodes positioned within the elongated housing of the lighting device 601. The lighting device 601 also preferably includes diffuser lenses, such as described with reference to FIG. 2B, positioned in front of each of the stacked arrays of light emitting diodes, wherein one of the diffuser lenses extends along a wall portion of the elongated housing of the lighting device 601 to provide soft-wash lighting that emits from side surfaces 611 of the diffuser lens when the top array of light emitting diodes is powered on. Preferably, side portions of the lighting device 601 are formed from two portions 603 and 605, with a top portion 605 being partially translucent to provide additional soft-wash lighting and an opaque housing portion.

FIGS. 7A-E show a lighting system 700 with a pendent-type light fixture 702 with an acoustic shroud 709 attached to the pendent-type light fixture 702 through quick release gravity assisted clips or gravity wedges 711/711' and 713/713'. In accordance with the embodiments, the quick release gravity assisted clips or gravity wedges 711/711' and 713/713' are attached to inner walls of the acoustic shroud 709. In operation, the acoustic shroud is fitted around outer wall of the a pendent-type light fixture 702 from a bottom surface 703 of the pendent-style light fixture 702, pushed upward and around the pendent-type light fixture 702, as indicated by the arrow 708. With the acoustic shroud 709 surrounding outer walls of pendent-style light fixture 702, bottom portions or raised wedge portions of the quick release gravity assisted clips or gravity wedges 711/711' and 713/713' overlap portions of a top surface 712 of the pendent-style light fixture 702 and rest thereon. Accordingly, the weight or gravity of the acoustic shroud 709 secures the acoustic shroud 709 in position on the pendent-style light fixture 702 via the quick release gravity assisted clips or gravity wedges 711/711' and 713/713'. The lighting system also include mounting features and cables 707 and 707' for hanging the pendent-style light fixture 702 from a ceiling structure, as described above.

In accordance with the embodiments of the invention, the acoustic shroud 709 is over-sized, such that the portions of the panels of the acoustic shroud 709 extend a distance that is greater than heights of the outside walls of the pendent-like light fixture 702, as shown.

Figure 8A:
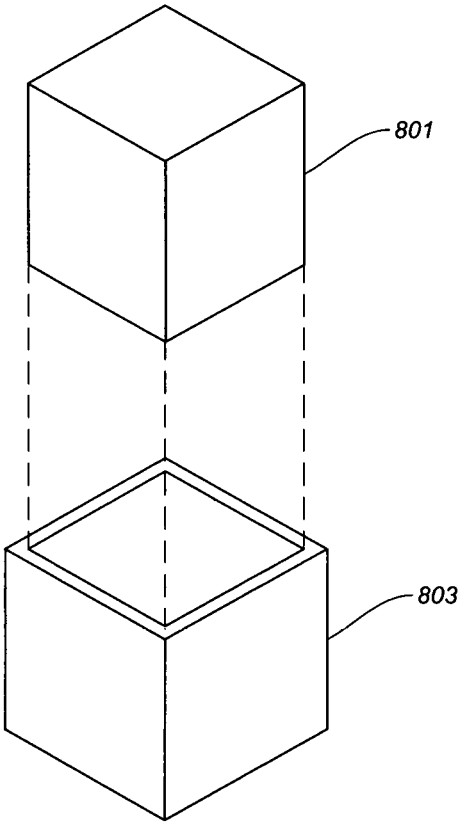
FIGS. 8A-B show full body and partial body end cap portions of an acoustic shroud for attaching to a light fixture, in accordance with the embodiments of the invention.
Figure 8B:
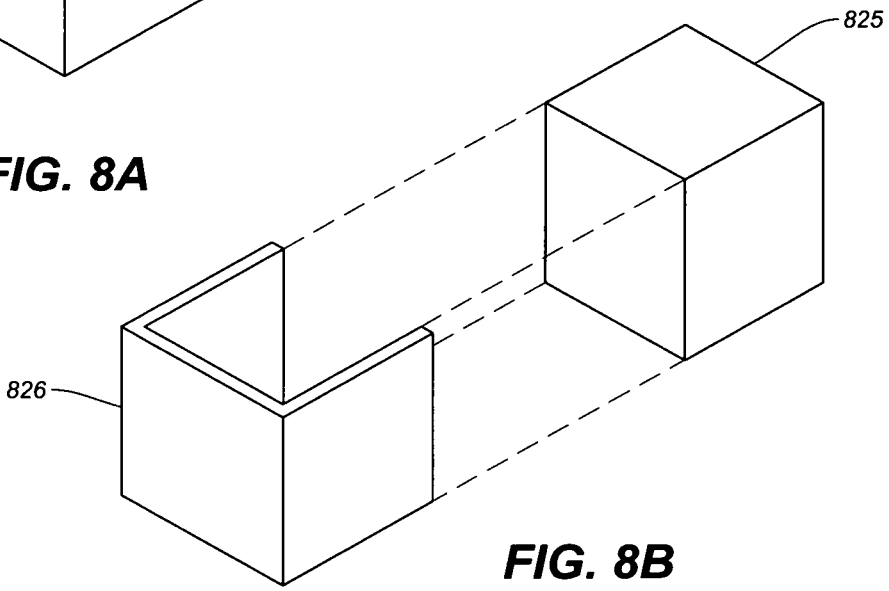

FIGS. 8A-B show portions of full body acoustic shroud structure 803 and partial body shroud structure 826 for capping end portions 801 and 825 of a light fixture or entire outside walls of the light fixture. It will be clear to one skilled in the art that an acoustic shroud of the present invention can be configured to cover any number of light fixture outside walls or combinations of light fixture outside walls. It will also be clear to one skilled in the art, that while it is preferred that the acoustic shroud does not cover lighting emitting surfaces of a light fixture, an acoustic shroud can be made to be translucent or partially transparent, such not to block or completely occlude light emitted from light emitting surfaces of the light fixture.

Figure 9A:
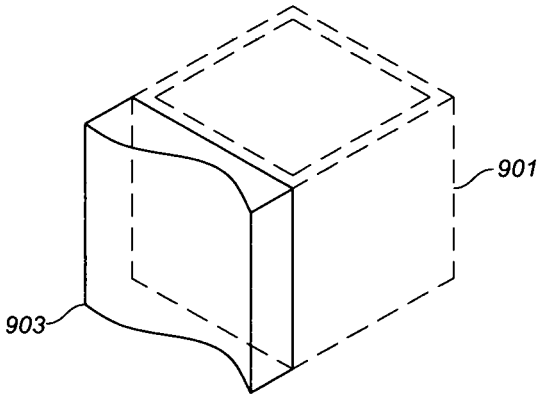
FIGS. 9A-C illustrate patterned features on outside surfaces of an acoustic light fixture shroud for dampening sound, accordance with the embodiments of the invention.
Figure 9B:
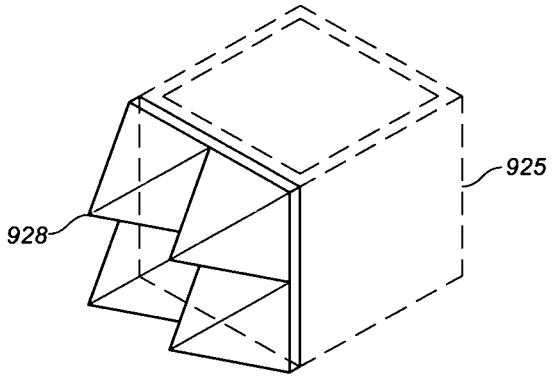
Figure 9C:
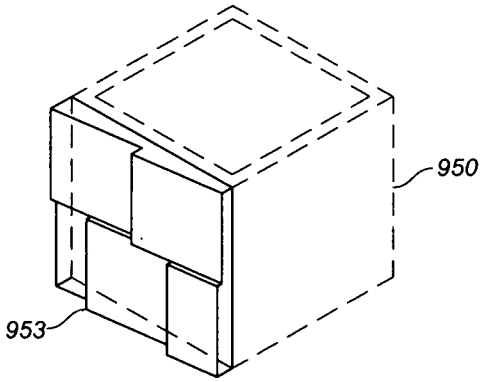

FIGS. 9A-C illustrate portions of outside surfaces of an acoustic light fixture shroud, such as the acoustic shroud 409 and 709 described with respect to FIG. 4 and FIGS. 7A-E, respectively. The acoustic light fixture shroud of the present invention is patterned with raised and depressed surfaces for dampening sound. FIG. 9A shows a wave patterned surfaces 903 on a portion of an acoustic shroud 901 attached to a light fixture. FIG. 9B shows a pointed or dimpled patterned surface 928 on a portion of an acoustic shroud 925 attached to a light fixture. FIG. 9C shows a raised tile patterned surface 953 on a portion of an acoustic shroud 950 attached to a light fixture. It will be clear to one skilled in the art that an acoustic shroud of the present invention can have any number of patterned or combination of patterned surfaces for dampening noise.

The present invention has been described in terms of specific embodiments incorporating details to facilitate the understanding of the principles of construction and operation of the invention. As such, references herein to specific embodiments and details thereof are not intended to limit the scope of the claims appended hereto. It will be apparent to those skilled in the art that modifications can be made in the embodiments chosen for illustration without departing from the spirit and scope of the invention. For example, an acoustic shroud of the present invention can be made to cover light fixtures of any shape, such a the light fixture 500 and 525 described in FIGS. 5A-B.

What is claimed is:

1. A lighting system comprising:

a) a pendent-type LED light fixture with outside walls; and b) an acoustic shroud structure formed from panels that surround the outside walls and dampen noise, wherein the system further include quick-release fasteners for affixing and removing the acoustic shroud structure from light fixture and wherein the quick-release fasteners include gravity assisted wedge clips that attach to inner walls of the acoustic shroud structure and that have raised wedge portions that rest on top surfaces of the pendent-type LED light fixture.

2. The lighting system of claim 1, wherein pendent-type LED light fixture includes mounting features for mounting the pendent-type LED light fixture to a ceiling or a wall.

3. The lighting system of claim 1, wherein the outside surfaces of the panels are patterned with raised and depressed surfaces.

4. The lighting system of claim 1, wherein the acoustic panels are formed from one or more materials selected from plastic, foam, cellulose, vegetable-based materials and woven fabric or cloth.

5. The lighting system of claim 1, wherein the acoustic shroud structure is over-sized, such that the panels that surround the outside walls extend a distance that is greater than heights of the outside walls of the pendent-type LED light fixture.

6. A lighting system comprising:

a) a pendent-type LED light fixture with outside walls;

b) an acoustic shroud structure formed from panels that surround the outside walls and dampen noise; and c) quick-release fasteners that include gravity assisted wedge clips that attach to inner walls of the acoustic shroud structure and have raised wedge portions that rest on top surfaces of the a pendent-type LED light fixture.

7. The lighting system of claim 6, wherein the outside surfaces of the panels are pattering with raised and depressed surfaces.

8. The lighting system of claim 6, wherein the acoustic panels are formed from one or more materials selected from plastic, foam, cellulose, vegetable-based materials and woven fabric or cloth.

9. The lighting system of claim 6, wherein the acoustic shroud structure is over-sized, such that the panels that surround the outside walls extend a distance that is greater than heights of the outside walls of the pendent-type LED light fixture.

10. A lighting system comprising:

a) a pendent-type LED light fixture with outside walls; and b) an acoustic shroud structure formed from panels that surround the outside walls and dampen noise, wherein the acoustic shroud structure is over-sized, such that the panels that surround the outside walls extend a distance that is greater than heights of the outside walls of the pendent-type LED light fixture, wherein the system further include quick-release fasteners for affixing and removing the acoustic shroud structure from the pendent-type LED light fixture and where in the quick-release fasteners include gravity assisted wedge clips at attach to inner walls of the acoustic shroud structure and have raised wedge portions that rest on top surfaces of the pendent-type LED light fixture.

11. The lighting system of claim 10, wherein pendent-type LED light fixture includes mounting features for mounting the pendent-type LED light fixture to a ceiling or a wall.

12. The lighting system of claim 10, wherein the acoustic panels are formed from one or more materials selected from plastic, foam, cellulose, vegetable-based materials and woven fabric or cloth.

* * * * *